United States Patent [19]

Miyahara et al.

[11] 4,369,076

[45] Jan. 18, 1983

[54] PROCESS FOR PRODUCING MAGNETIC METAL POWDER

[75] Inventors: Tesshu Miyahara, Ohmiya; Yoshi Arai, Oyama; Kazuo Kimura, Kazo, all of Japan

[73] Assignees: Dainippon Ink & Chemicals Inc., Tokyo; Kawamura Institute of Chemical Research, Saitama, both of Japan

[21] Appl. No.: 274,732

[22] Filed: Jun. 18, 1981

[30] Foreign Application Priority Data

Jun. 20, 1980 [JP] Japan ..... 55-82961

[51] Int. Cl.[3] ..... H01F 1/02

[52] U.S. Cl. ..... 148/105; 75/0.5 AA; 75/0.5 BA; 427/127

[58] Field of Search ..... 148/105; 75/0.5 AA, 75/0.5 BA; 427/127, 216, 217, 220

[56] References Cited

U.S. PATENT DOCUMENTS

| | | | |
|---|---|---|---|
| 1,855,562 | 4/1932 | Swinne | 427/127 |
| 3,549,412 | 12/1970 | Frey et al. | 427/217 |
| 4,165,232 | 8/1979 | Jaeckh et al. | 427/127 |

*Primary Examiner*—John P. Sheehan

*Attorney, Agent, or Firm*—Sherman & Shalloway

[57] ABSTRACT

A process for producing a magnetic metal powder having improved oxidation resistance and magnetic properties, which comprises wetting a magnetic metal powder in an atmosphere of a non-oxidizing gas with a solution of a boron trialkoxide in a solvent being inert to the magnetic metal powder and capable of dissolving the boron trialkoxide; and thereafter evaporating off the solvent.

5 Claims, 4 Drawing Figures

B-0
B-2
B-1
200
150
100
50
20
50
100
150
200
TEMPERATURE OF HEATING IN AIR (°C)
σm (at 10 KOe)

PROCESS FOR PRODUCING MAGNETIC METAL POWDER

This invention relates to a process for producing a magnetic metal powder for recording.

In recent years, with the development of high-density magnetic recording technology, it has been proposed to use acicular magnetic metal powders having a high coercivity and a high saturation magnetic moment as a recording element of recording media, and some have already gained commercial acceptance. Since the acicular magnetic metal powders are as small as less than 1 μm in length, they are chemically very active, have poor oxidation resistance, and in an extreme case, undergo abrupt oxidation reaction at room temperature in the air, thus being spontaneously set on fire. In order to prevent combustion and take them out stably in the air or to acquire oxidation resistance, various methods have been proposed. Among them are:

(1) A method which comprises dipping in an organic solvent such as toluene a magnetic metal powder immediately after production by reduction, then taking it out in the air, and gradually oxidizing it while volatilizing the solvent thereby to form a thin oxide coating on the surface of the particles (see Japanese Laid-Open Patent Publication No. 97738/1974).

(2) A method which comprises adhering an amine, a mineral oil and a silane coupling agent to the surface of a magnetic metal powder (Japanese Laid-Open Patent Publication No. 76958/1978).

(3) A method which comprises suspending a magnetic metal powder in an aqueous solution of sodium hydroxide and then passing an oxygen-containing gas through the suspension to form a compact magnetite coating on the surface of the particles (Japanese Laid-Open Patent Publication No. 114769/1978).

(4) A method which comprises mixing a magnetic metal powder and a higher fatty acid powder in an organic solvent with stirring to form a higher fatty acid film on the surface of the particles (Japanese Laid-Open Patent Publication No. 97738/1974).

(5) A method which comprises adhering an amino-modified silicone oil to the surface of a magnetic metal powder (Japanese Laid-Open Patent Publication No. 77270/1979).

The magnetic metal powders based on the prior art techniques disclosed in these patent documents do not sufficiently exhibit the excellent magnetic characteristics of the raw metals. Since the antioxidant coating on the surface of the magnetic metal powder must be very thick according to the conventional techniques, the inconvenience of reduced saturation magnetic moments cannot be avoided.

It is an object of this invention therefore to provide a magnetic metal powder having excellent oxidation resistance and fully satisfactory magnetic properties.

According to this invention, an improved magnetic metal powder meeting the above object can be produced by wetting a magnetic metal powder in an atmosphere of a non-oxidizing gas with a solution of a boron trialkoxide in a solvent being inert to the magnetic metal powder and capable of dissolving the boron trialkoxide, and then evaporating off the solvent.

It is believed, without any restriction by theory, that according to the process of this invention, the boron trialkoxide adhering to the surface of the magnetic metal powder is hydrolyzed by the small amount of water present on the surface of the magentic metal powder to form a boron oxide coating. This coating is compact and stable and therefore imparts excellent oxidation resistance to the magnetic metal powder even when it is thin. The achievement of the object of the invention by the aforesaid process is surprising in view of the fact that a magnetic metal powder which is surface-treated with another boron compound such as boric acid cannot retain its original high levels of magnetic properties and its saturation magnetic moment is reduced even at room temperature.

The improved magnetic metal powder in accordance with this invention has good handleability and storage stability in the air, and can be stored in powder form in great quantities. Since this surface coating is also stable in coating binders used in the production of magnetic tapes and other recording media, the improved magnetic metal powder is a very good material for magnetic recording media.

The magnetic metal powder in the present invention is an acicular powder, less than about 1 μm in length, of iron, cobalt, cobalt-nickel alloy, cobalt-iron alloy, iron-nickel-cobalt alloy, etc.

Examples of the boron trialkoxides which can be used in this invention are trimethyl borate, triethyl borate, and tributyl borate.

The improved magnetic metal powder of the invention can be produced by wetting a magnetic metal powder in an atmosphere of a non-oxidizing gas with a solution of the boron trialkoxide in a specified solvent, and then evaporating off the solvent. The wetting may, for example, be effected by dipping the magnetic metal powder in the aforesaid solution.

The solvent should be inert to the magnetic metal powder and be able to dissolve the boron trialkoxide. Examples include benzene, toluene, acetonitrile, pyridine, xylene, methanol, ethanol, and butanol. Toluene is especially preferred in view of its safety, handlability and economy.

It is essential that the wetting of the magnetic metal powder with the aforesaid solution is carried out in an atmosphere of a non-oxidizing gas for the magnetic metal powder. This prevents the oxidation of the metal powder. Nitrogen gas, hydrogen gas and rare gases such as helium and argon can, for example, be utilized as the non-oxidizing gas.

The step of evaporating the solvent alone while leaving the boron trialkoxide on the surface of the magnetic metal powder is carried out by heating or under reduced pressure. Preferably, this step is also carried out in an atmosphere of a non-oxidizing atmosphere. If desired, the wetted magnetic metal powder may simply be air-dried. The temperature at which the evaporation is done by heating differs depending upon the type of the solvent used, but is preferably about 60° to about 200° C.

The amount of the boron trialkoxide is such that the amount of a substance (oxidation-resistant coating) finally adhered to the magnetic metal powder is 0.01 to 1 boron atom, preferably 0.1 to 1 boron atom, per metal atom. If the amount adhered is smaller than the specified limit, sufficient oxidation resistance cannot be obtained, and if it is too large, a high saturation magnetic moment cannot be obtained.

The improved magnetic metal powder in accordance with this invention has a maximum magnetic moment $\sigma_m$ of about 170 emu/g to 180 emu/g in a field of 10 KOe. If the amount of the boron trialkoxide is increased, the maximum magnetic moment of the magnetic metal powder remains at about 160 emu/g even when it is continuously heated at 200° C. for 1 hour in the air. Heating in the air at 200° C. for 1 hour represents very severe oxidation conditions. Of course, this improved magnetic metal powder scarcely changes with time when left to stand in the air at room temperature.

When a magnetic coating is formed by using a binder, a binder layer forms on the oxidation-resistant layer. Thus, the oxidation resistance of the magnetic metal powder is usually enhanced.

The improved magnetic metal powder in accordance with this invention has very good oxidation resistance and can retain its high levels of magnetic properties for an extended period of time. It has excellent storage stability, and when processed into a recording medium such as a magnetic tape, it withstands high-density recording. Accordingly, the magnetic metal powder of the invention is suitable for use in video tapes as well as in high-performance audio tapes. In a video recorder, a temperature rise at the magnetic head portion is much higher than in an audio recorder. Since the improved magnetic metal powder of the invention has excellent heat resistance, its use in video tapes produces especially good results. Furthermore, tapes obtained by using the improved magnetic metal powder of the invention can permit recording and storage for longer periods of time than conventional tapes.

The accompanying drawings are graphs showing the maximum magnetic moments ($\sigma_m$) of the metallic iron powders having a coercivity (Hc) of 1000 to 1200 Oe prepared in the following Examples which were measured after these powders had been heated in the air for 1 hour at varying temperatures within the range of20° to 200° C. In these drawings, FIG. 1 is a graph showing the measured values of the metallic iron powders prepared in Example 1 and Comparative Example 1;

EXAMPLE 1

Figure 1:
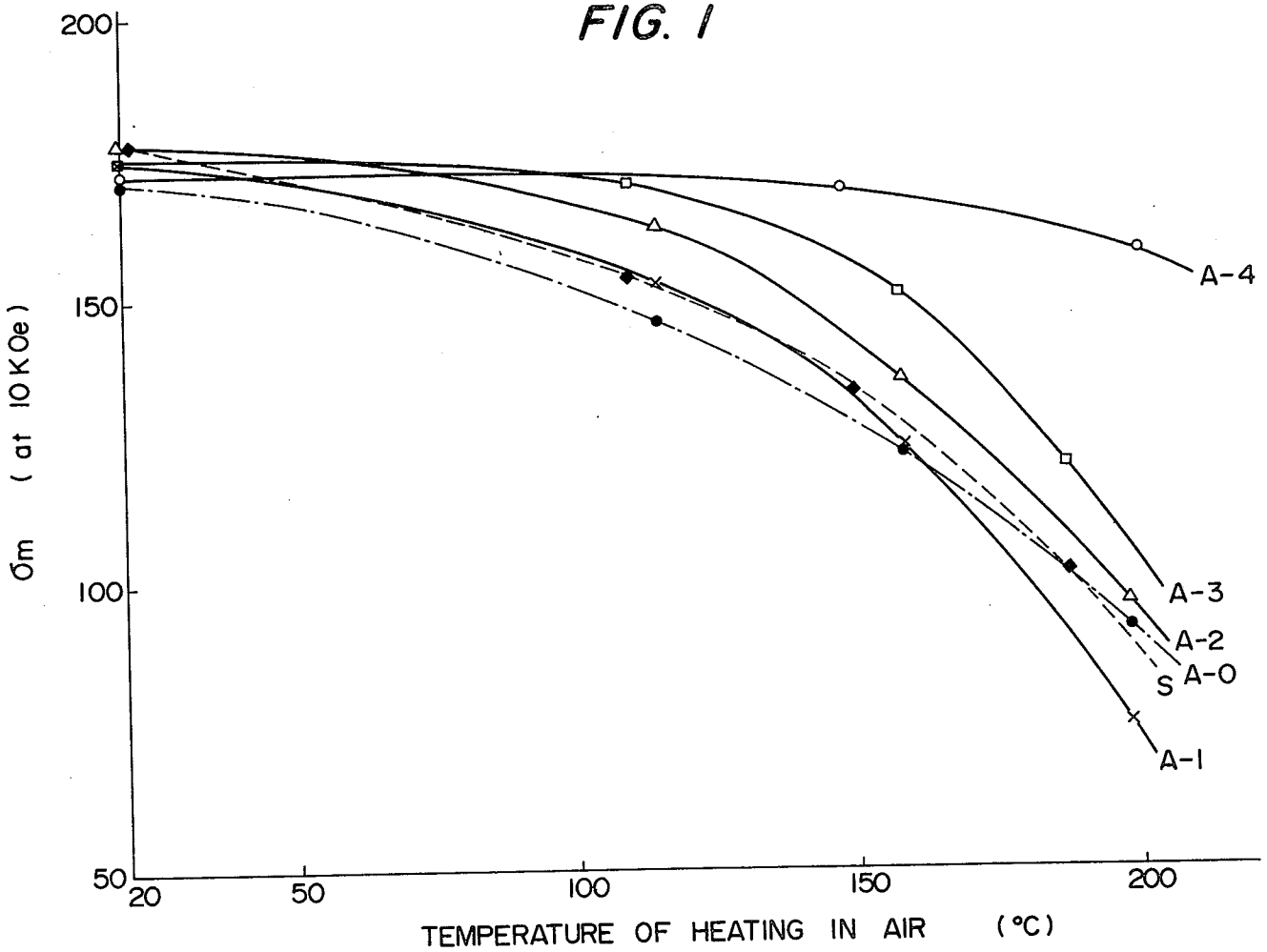

Ten grams of acicular goethite ($\alpha$-FeOOH having an acicular ratio of less than about 10) was put in a reducing furnace. After replacing the air with nitrogen gas, the temperature was raised in a hydrogen gas flowing at a rate of 4 liters/min. The geothite was thus reduced at 400° C. for 2 hours to form a metallic iron powder. The temperature was lowered to room temperature, and again the atmosphere was replaced by nitrogen gas. The metallic iron powder so obtained was put in 300 g of a toluene solution of trimethyl borate in various concentrations, and well dispersed. The dispersion was evaporated to dryness in an atmosphere of nitrogen to obtain a magnetic iron powder having adhered thereto trimethyl borate (probably boron oxide as stated hereinabove . . . the same can be said in the following examples).

The samples obtained by the above methods were classified below by the amount of trimethyl borate based on the iron reduced. Specifically, the sample containing trimethyl borate in an amount of 2 atomic % as boron atom per iron atom is designated as A-1; the sample having 20 atomic % of boron atom, as A-2; the sample having 30 atomic % of boron atom, as A-3; and the sample having 100 atomic % of boron atom, as A-4.

COMPARATIVE EXAMPLE 1

A magnetic iron powder was prepared in the same way as in Example 1 except that an amino-modified silicone oil was used instead of trimethyl borate. This magnetic iron powder showed the best magnetic properties and oxidation resistance when the amount of the amino-modified silicone oil adhered is 1 atomic % as silicon atom per iron atom. This magnetic iron powder is designated as S.

A magnetic iron powder having an oxide coating was produced in the same way as in Example 1 except that pure toluene was used instead of the toluene solution of trimethyl borate. This produce is designated as A-O.

EXAMPLE 2

A magnetic iron powder having trimethyl borate adhered thereto was produced in the same way as in Example 1 except that the magnetic iron powder in the dispersion was dried by a filtration drying method.

The samples obtained in this matter were classified below by the amount of trimethyl borate. Specifically, the sample containing trimethyl borate in an amount of 2 atomic % as boron atom based on the iron reduced is designated as B-1; and the sample having 10 atomic % of boron atom, as B-2.

COMPARATIVE EXAMPLE 2

A magnetic iron powder having an oxide coating was produced in the same way as in Example 1 except that pure toluene was used instead of the toluene solution of trimethyl borate. The product is designated as B-O.

EXAMPLE 3

A magnetic iron powder having triethyl borate adhered thereto was produced in the same way as in Example 1 except that triethyl borate was used instead of trimethyl borate.

The samples obtained were classified below by the amount of triethyl borate. Specifically, the sample containing triethyl borate in an amount of 10 atomic % as boron atom based on the iron reduced is designated as C-1; the sample having 20 atomic % of boron atom, as C-2; and the sample having 80 atomic % of boron atom, as C-3.

COMPARATIVE EXAMPLE 3

A magnetic iron powder having an oxide coating was produced in the same way as in Example 3 except that pure toluene was used instead of the toluene solution of triethyl borate. The product is designated as C-O.

Example 4

Magnetic iron powders having tributyl borate adhered thereto were produced in the same way as in Example 1 except that tributyl borate was used instead of trimethyl borate.

The resulting iron powders were classified below by the amount of tributyl borate adhered. The powder containing tributyl borate in an amount of 10 atomic % as boron atom based on the iron reduced is designated as D-1; the powder having 20 atomic % of boron atom, as D-2; the powder having 40 atomic % of boron atom, as D-3; and the powder having 80 atomic % of boron atom, as D-4.

COMPARATIVE EXAMPLE 4

A magnetic iron powder having an oxide coating was produced in the same way as in Example 4 except that pure toluene was used instead of the toluene solution of tributyl borate. The produce is designated as D-O.

TEST EXAMPLE

Figure 2:
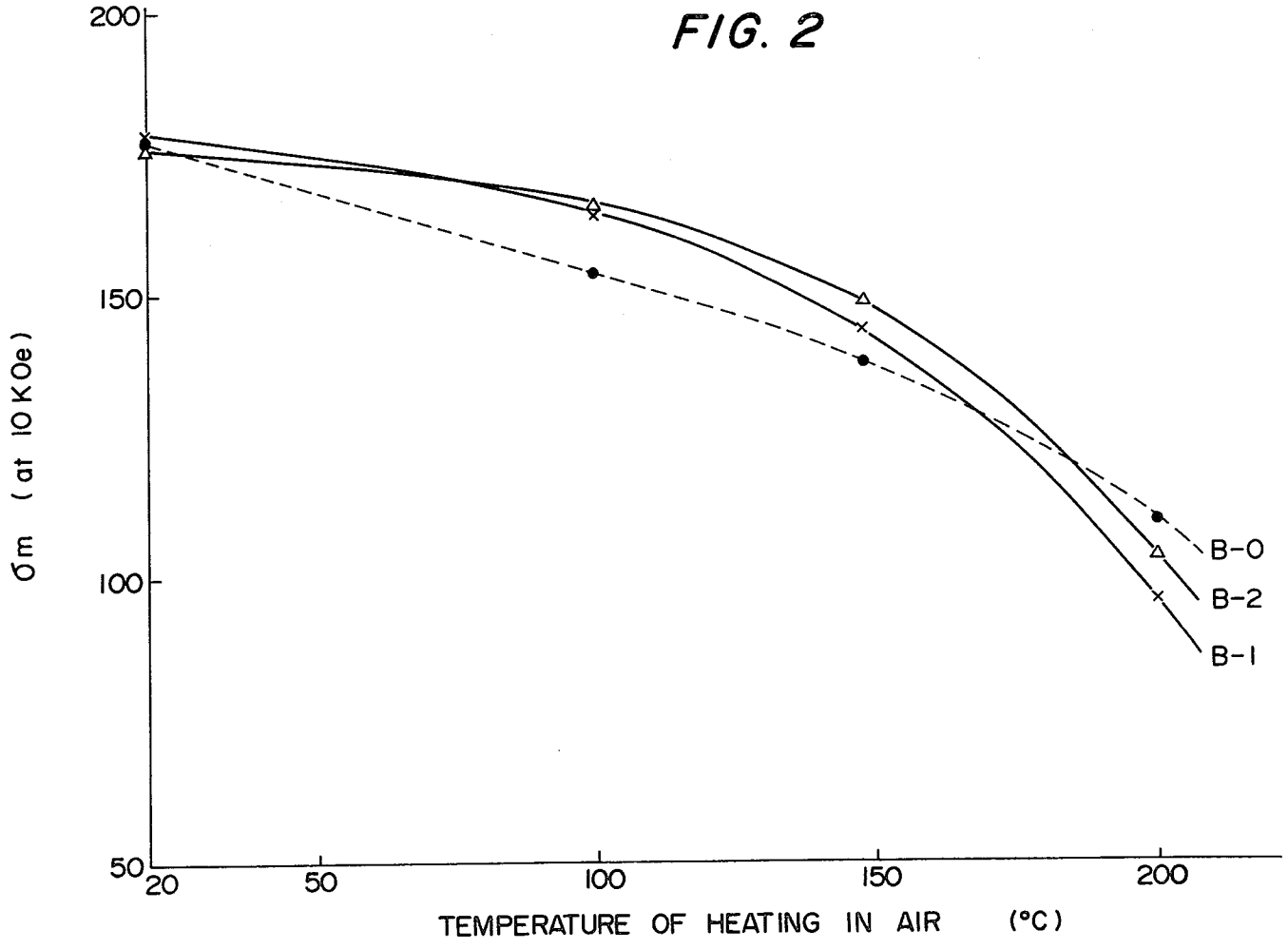
FIG. 2 is a graph showing the measured values of the metallic iron powders prepared in Example 2 and Comparative Example 2.
Figure 3:
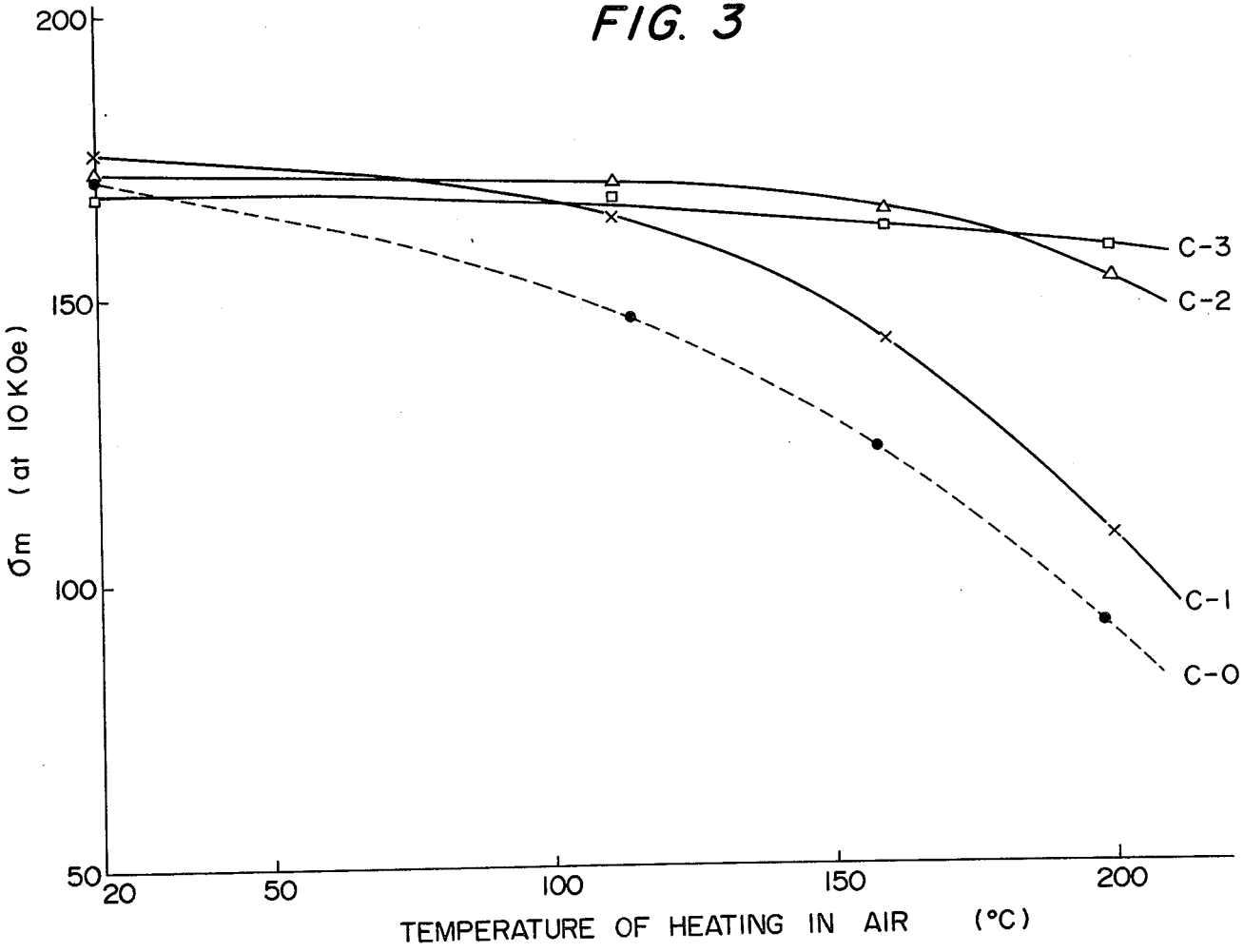
FIG. 3 is a graph showing the measured values of the metallic iron powders prepared in Example 3 and Comparative Example 3.
Figure 4:
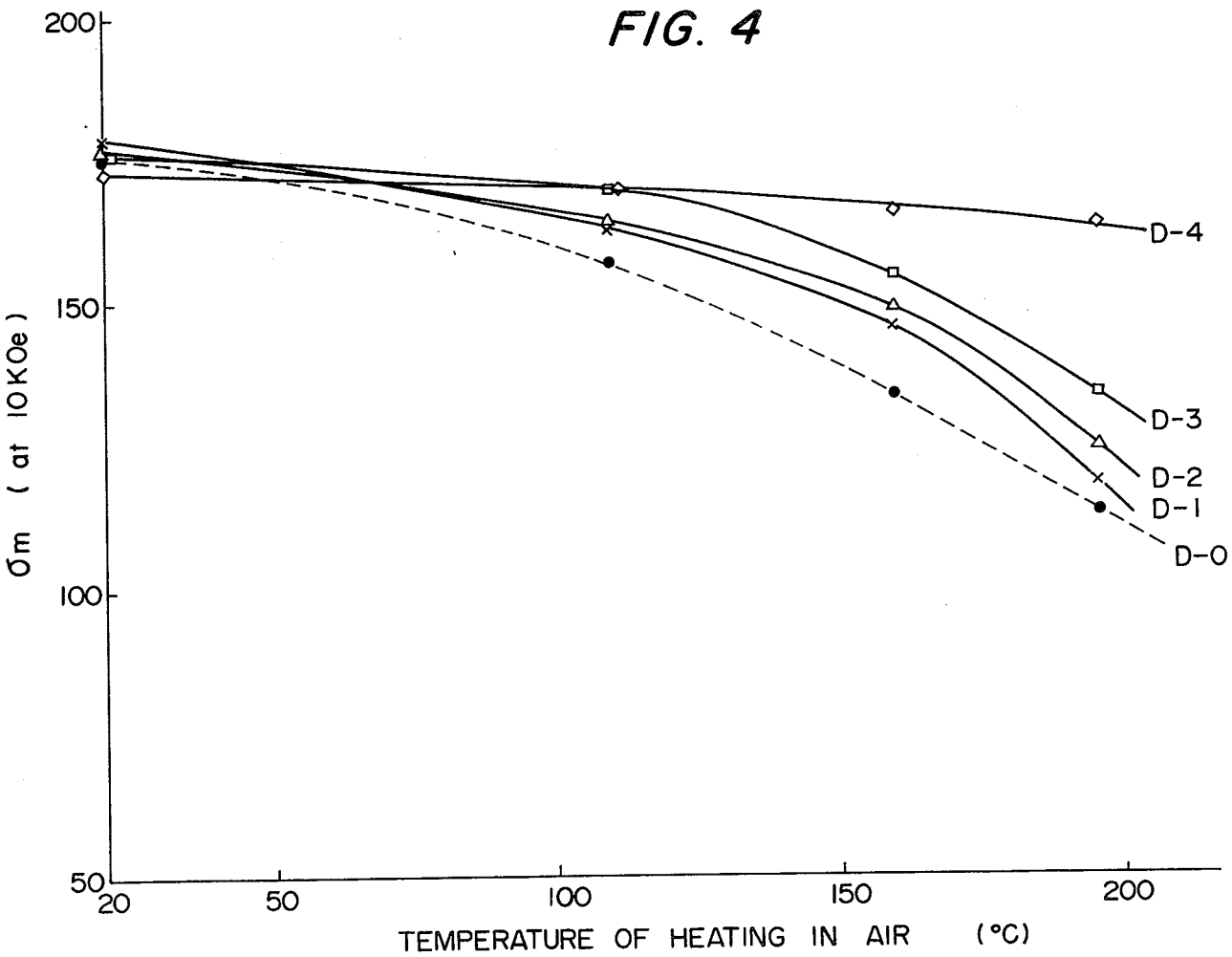
FIG. 4 is a graph showing the measured values of the metallic iron powders prepared in Example 4 and Comparative Example 4.

The metallic iron powder samples having a coercivity of 1000 to 1200 Oe obtained in the above examples were each heated in the air from 1 hour at various temperatures within the range of 20° to 200° C., and then the magnetic moments $\sigma_m$ of the heated metallic iron powders were each measured by a vibrating sample magnetometer in an applied magnetic field of 10KOe. Thus, the decrease of $\sigma_m$ by oxidation was examined. The results are plotted in FIGS. 1 to 4. It is seen from these results that the metallic iron powders obtained in the above examples having boron trialkoxides such as trimethyl borate, triethyl borate and tributyl borate adhering to their surfaces have very good oxidation resistance while having a high saturation magnetic moment.

What is claimed is:

1. A process for producing a magnetic metal powder having improved oxidation resistance and magnetic properties, which comprises wetting a magnetic metal powder in an atmosphere of a non-oxidizing gas with a solution of a boron trialkoxide in a solvent being inert to the magnetic metal powder and capable of dissolving the boron trialkoxide; and thereafter evaporating off the solvent, wherein the amount of the boron trialkoxide is such that the amount of a substance finally adhering to the magnetic metal powder is 0.01 to 1 boron atom per metal atom.

2. The process of claim 1 wherein the boron trialkoxide is trimethyl borate, triethyl borate or tributyl borate.

3. The process of claim 1 wherein the solvent is evaporated in an atmosphere of a non-oxidizing gas.

4. The process of claim 1 wherein the amount of the boron trialkoxide is such that the amount of a substance finally adhering to the magnetic metal powder is 0.1 to 1 boron atom per metal atom.

5. The process of claim 1 wherein the solvent is evaporated by air-drying at a temperature in the range of from about 60° to about 200° C.

* * * * *